US008324491B1

(12) United States Patent
Malluck

(10) Patent No.: US 8,324,491 B1
(45) Date of Patent: Dec. 4, 2012

(54) WIND INSTRUMENT UTILIZING CARBON FIBER REINFORCED COMPOSITE LAMINATE AND ASSOCIATED FABRICATION METHOD

(76) Inventor: John Andrew Malluck, Richmond Hill, GA (US)

( * ) Notice: Subject to any disclaimer, the term of this patent is extended or adjusted under 35 U.S.C. 154(b) by 36 days.

(21) Appl. No.: 13/035,957

(22) Filed: Feb. 26, 2011

(51) Int. Cl.
*G10D 9/00* (2006.01)

(52) U.S. Cl. ..... 84/387 R; 84/380 R

(58) Field of Classification Search ..... 84/387, 84/387 R
See application file for complete search history.

(56) References Cited

U.S. PATENT DOCUMENTS

| | | | | | |
|---|---|---|---|---|---|
| 52,580 | A | * | 2/1866 | Lehnert | 84/387 R |
| 856,642 | A | * | 6/1907 | Jay | 84/394 |
| 2,187,562 | A | * | 1/1940 | Smith | 425/175 |
| 2,730,003 | A | * | 1/1956 | Loney | 84/380 R |
| 2,995,781 | A | | 8/1961 | Sipler | |
| 3,308,706 | A | * | 3/1967 | Arnold | 84/380 R |
| 3,393,263 | A | | 7/1968 | Brilhart | |
| 3,561,905 | A | * | 2/1971 | Linton | 84/380 R |
| 3,805,665 | A | * | 4/1974 | Oouchi | 84/380 C |
| 3,861,264 | A | * | 1/1975 | Matsumoto et al. | 84/387 R |
| 4,273,020 | A | * | 6/1981 | Happe | 84/394 |
| 4,306,484 | A | * | 12/1981 | Toyama | 84/380 R |
| 4,515,061 | A | * | 5/1985 | Ferron | 84/394 |
| 4,757,738 | A | * | 7/1988 | Armstrong | 84/394 |
| 4,860,629 | A | * | 8/1989 | Del Giudice | 84/395 |
| 4,998,456 | A | * | 3/1991 | Kahonen | 84/384 |
| 5,027,685 | A | * | 7/1991 | Lenz | 84/330 |
| 6,153,029 | A | * | 11/2000 | Lin | 148/519 |
| 6,538,183 | B2 | * | 3/2003 | Verd | 84/291 |
| 6,547,210 | B1 | * | 4/2003 | Marx et al. | 249/175 |
| 6,696,629 | B1 | * | 2/2004 | Cooper, Jr. | 84/385 R |
| 6,713,130 | B1 | | 3/2004 | Kuno et al. | |
| 6,852,917 | B2 | * | 2/2005 | McAleenan | 84/380 R |
| 7,112,735 | B2 | * | 9/2006 | Shire | 84/395 |
| 7,179,977 | B1 | * | 2/2007 | Kelly | 84/398 |

(Continued)

FOREIGN PATENT DOCUMENTS

| | | |
|---|---|---|
| FR | 2790585 | 9/2000 |

(Continued)

OTHER PUBLICATIONS

Jacoby, M., Composite Materials, Chemical & Engineering News, Aug. 30, 2004, pp. 34-39,vol. 82, No. 35, American Chemical Society, USA.

(Continued)

*Primary Examiner* — David S. Warren
*Assistant Examiner* — Robert W Horn

(57) ABSTRACT

A lip-reed wind instrument composed substantially, or in part, of carbon fiber reinforced composite laminate and an associated method to fabricate the instrument. Carbon fiber reinforced composite laminate is used to construct the tubular sidewalls of the instrument and is beneficial to the musical character. The high stiffness and low density of carbon fiber reinforced composite laminate increases the frequency of the instrument's vibration mode shapes allowing a favorable cooperation with musical pitch. The result is an instrument having improved projection as well as a brilliant timbre. The associated fabrication method describes the specialized tooling and the techniques to construct the laminate features of the instrument. The construction methods together with the improvements result in an instrument of higher precision allowing consistent play qualities for instruments of like design.

20 Claims, 10 Drawing Sheets

U.S. PATENT DOCUMENTS

| | | | | |
|---|---|---|---|---|
| 7,262,353 | B2 * | 8/2007 | Bartholomew et al. | 84/282 |
| 7,608,768 | B2 * | 10/2009 | Thanyakij | 84/385 R |
| 2003/0015082 | A1 * | 1/2003 | Brennan | 84/380 R |
| 2007/0113721 | A1 * | 5/2007 | Kelly | 84/398 |
| 2008/0223193 | A1 * | 9/2008 | Miyaoka | 84/380 R |
| 2012/0024127 | A1 * | 2/2012 | Rashleigh | 84/396 |

FOREIGN PATENT DOCUMENTS

| | | | |
|---|---|---|---|
| GB | 0906968.3 | * | 4/2009 |
| JP | 63-274995 | | 11/1988 |

OTHER PUBLICATIONS

Meltzer, P. Researchers Partner with the Canadian Brass on Testing of Composites for Instruments, Aerospace Components, Air Force Research Laboratory Press Release, 2003, AFRL 03-0083, Materials and Manufacturing Directorate Public Affairs, Wright Patterson Air Force Base, OH.

* cited by examiner

WIND INSTRUMENT UTILIZING CARBON FIBER REINFORCED COMPOSITE LAMINATE AND ASSOCIATED FABRICATION METHOD

BACKGROUND

1. Field of the Invention

This invention relates generally to wind musical instruments, more particularly to the materials and construction of lip-reed wind instruments.

2. Prior Art

The following is a tabulation of some prior art that presently appears relevant:

| U.S. patents | | | |
|---|---|---|---|
| Pat. No. | Kind Code | Issue Date | Patentee |
| 6,852,917 | B2 | Feb. 8, 2005 | McAleenan |
| 6,713,130 | B1 | Mar. 30, 2004 | Kuno et al. |
| 4,998,456 | | Apr. 4, 1991 | Kahonen |
| 4,860,629 | | Aug. 29, 1989 | Del Giudice |
| 2,995,781 | | Aug. 15, 1961 | Sipler |

NONPATENT LITERATURE DOCUMENTS

Jacoby, M., Chemical & Engineering News, "Composite Materials" Volume 82, Number 35 pp 34-39, Aug. 30, 2004

The present invention is directed to the materials and construction of instruments belonging to the lip-reed family of musical instruments wherein the improvements achieve an instrument having enhanced musical qualities as well as superior damage and corrosion resistance. The present invention is also directed to a method of fabrication resulting in an instrument of improved precision qualities.

Modern wind musical instruments played with a bored mouthpiece and excited using vibrations from a player's lips belong to the lip-reed family of wind instruments. The family of lip-reed instruments includes but is not limited to the trumpet, natural trumpet, clarino, bugle, flugelhorn, trombone, alto horn, French horn, baritone, euphonium and tuba.

Prior art lip-reed instruments are typically constructed of a series of interconnected brass-alloy tubular sections, both linear and curving, and may feature a number of valved extensions or a slide mechanism to extend the tubular length of the instrument. Using this arrangement some or all of the pitches of the chromatic scale can be produced allowing for extensive use in varied types of musical composition.

The main pipe of lip-reed instruments plays an important role in the production of musical pitches. The pipe's sidewall serves as a waveguide to contain acoustic waves as they travel longitudinally along the main bore. The waveguide properties of a lip-reed instrument's main pipe allows for the formation of standing waves whose natural frequencies correspond to the fundamental and harmonic tones in timbered musical pitches.

The present invention addresses the materials used to construct lip-reed instruments. As such, it is useful to describe the influence of prior art brass alloy materials on the instrument's acoustic and vibration characteristics. The brass alloy materials play a role in the modal vibration, whereby the instrument takes on a mode shape, or vibration pattern. As an example, FIG. 1 illustrates an exaggerated mode shape for a flugelhorn. In this example, the instrument starts at rest, takes on a positive bowed shape, returns to rest, takes on a negative bowed shape and returns to rest over a single cycle. The mode shape is controlled by the mass and stiffness of the instrument which work together to create the mode shape resonance. A lip-reed instrument will have many distinct mode shapes which occur at corresponding natural frequencies. The excitation of the mode shapes is caused primarily by vibration originating from the mouthpiece and traveling throughout the instrument.

During pitch production, excitation of mode shapes has the potential to enhance the timbre of lip-reed instrument but generally do not because of the brass alloy materials that are typically used. The timbre is undistinguished because the significant mode shape frequencies are lower than the acoustic standing-wave natural frequencies. Hence there is limited cooperation between these two mechanisms during pitch production. A primary reason for the lower mode shape natural frequencies is the low bending stiffness of brass alloy curved sections of the main pipe. The curved sections have a bending stiffness that is lower than the bending stiffness in linear sections and is an area that is strained considerably during mode shape vibration. Another reason for the lower natural frequencies is the high mass of the brass alloy tubular sections, which are forced into motion as part of the mode shape. The high mass combined with the low stiffness of the brass alloy tubing results in an instrument that has inferior timbre qualities.

The growth of corrosion is a significant issue associated with prior art lip-reed instruments constructed of brass alloy. During play, moisture and electrolyte material are transmitted into the bore of the brass alloy tubing which remains in place until the instrument is properly cleaned. This results in corrosion scale growth that impacts the acoustic properties due to the encroachment on the bore cross sectional area. The bore cross sectional area is an important parameter affecting the acoustic standing wave pattern and standing wave natural frequencies. The impact of the corrosion is confirmed by seasoned players who observe that old instruments do not respond like new instruments free from corrosion. Corrosion can also be a structural problem for lip-reed instruments constructed of brass alloy. Brass alloy suffers from red-rot corrosion which results in deterioration of the instrument structure.

Prior art lip-reed instruments are susceptible to structural damage. During operation, instruments are occasionally subject to impact loading due to sudden contact with other objects. The use of brass alloy material renders instruments susceptible to such damage because of its high malleability and low yield stress. Instruments constructed of brass alloy require costly repairs when damage occurs. This is particularly the case for damaged curved sections which require specialized skills and tooling to repair.

Prior art brass-alloy instruments are constructed with a large degree of hand craftsmanship which lends itself to unpredictable geometric variation each time an instrument is fashioned. The construction of the brass-alloy curved sections is an area where a significant degree of production variation can be attributed. The brass-alloy curved sections are fabricated from straight tubing sections which are given the correct bore size using a drawing process. After drawing, the tubing is filled with a solid but bendable core material and the filled tubing is bent around a curved mandrel. During the bending process the core material preserves the volume of the bore. However, the cross section is distorted in an unpredictable manner resulting in acoustical irregularities. This problem is especially apparent in curved tubes with changing cross sectional dimensions as there are no additional operations available to consistently correct the irregular cross section. It is also common during the bending process to hammer the interior of the curved section to preserve a smooth sidewall. This hammering operation results in further variation by unpredictably altering the stiffness properties of the sidewall.

The inconsistent aspects of prior art brass-alloy manufacture result in two problems:

1) Instruments of like design commonly have differing vibro-acoustic response. It is common for seasoned players to trial a number of like designed instruments in order to select one that is acceptable.
2) Instrument design algorithms used to optimize the geometric and stiffness properties often propose design changes that are minute compared to the achievable manufacturing tolerances. Thus, fully optimized instrument design is not feasible under the prior art.

DRAWINGS

Figures

Figure 1:
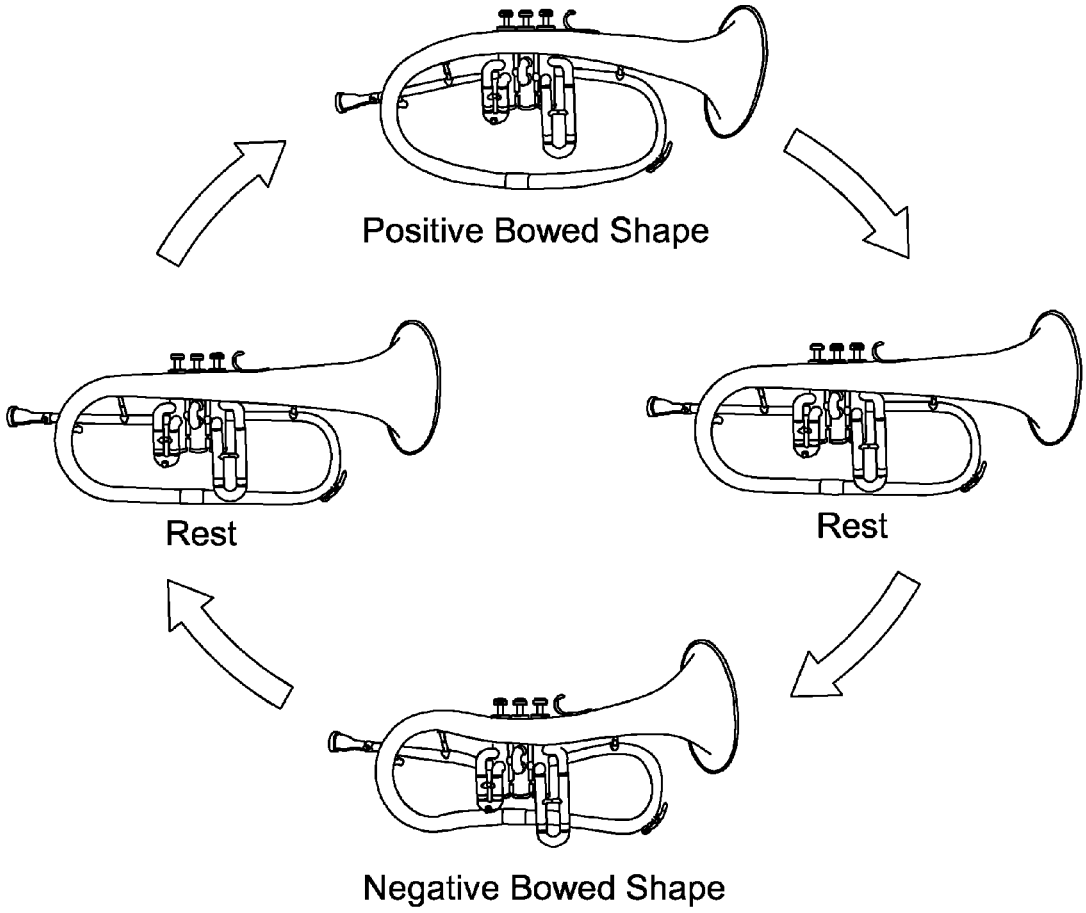
Figure 1 (Prior Art)
FIG. 1 is a diagram showing the exaggerated cyclic motion of a flugelhorn mode shape.

| Drawings—Reference Numerals | |
|---|---|
| 21 | bored mouthpiece |
| 22 | tubular section |
| 23 | curved section |
| 24 | flared bell |
| 25 | valved extension |
| 26 | pistons |
| 27 | linear section |
| 28 | valve casing |
| 29 | brace |
| 31 | male mandrel |
| 32 | bladder |
| 33 | reinforcement and resinous material |
| 34 | female mold upper half |
| 35 | female mold lower half |
| 36 | air supply line |
| 41 | linear tube |
| 42 | bight section |
| 43 | water key |
| 51 | rigid section |
| 52 | disintegrable section |
| 61 | leadpipe |
| 62 | tuning slide |

-continued

| Drawings—Reference Numerals | |
|---|---|
| 63 | lower tube |
| 64 | first knuckle |
| 65 | second knuckle |
| 66 | hook pipe |
| 71 | long segment |
| 72 | short segment |

DETAILED DESCRIPTION

The invention will be more fully understood from the following detailed description, in conjunction with the accompanying figures. The descriptions include five embodiments and associated methods of fabrication. The description of the fabrication is focused on the composite laminate features of the embodiments because existing methods can be used to fabricate the non-laminate features.

DETAILED DESCRIPTION

Figure 2:
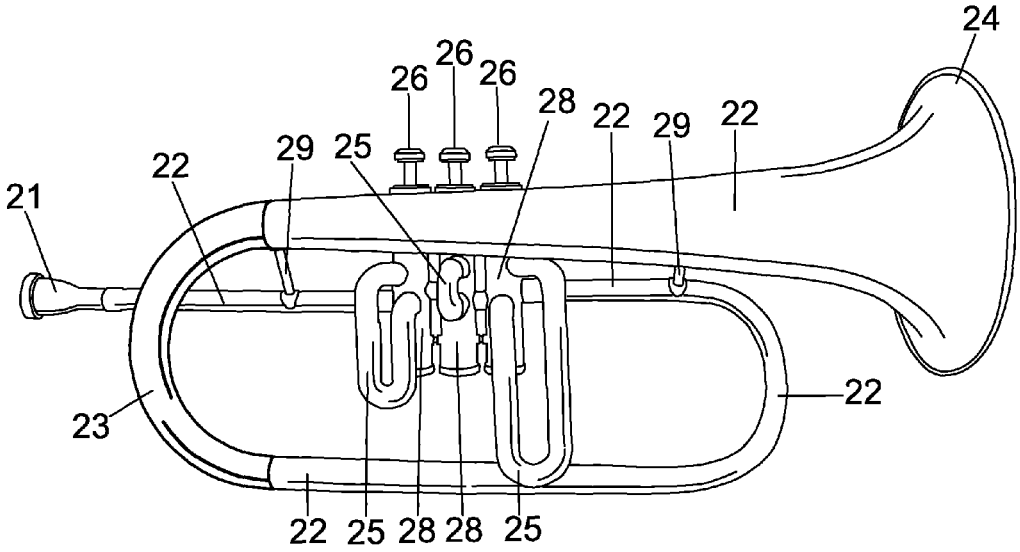
FIG. 2 is a perspective view of the first embodiment of the invention.

FIG. 2—First Embodiment

FIG. 2 shows a first embodiment of the wind instrument. The wind instrument has a bored mouthpiece 21, a main pipe, valved extensions 25, valve casings 28, pistons 26, braces 29, and a flared bell 24. The mouthpiece has a mouthpiece bore, shaped to propagate acoustic pressure produced by the vibration of a player's lips. The mouthpiece bore is attached to the main bore of the main pipe. The main pipe is composed of a series of interconnected tubular sections 22, and a curved section 23. The curved section is constructed of a composite laminate having at least a layer of carbon fiber reinforcement. The valve casings, pistons and valved extensions are nested within the main pipe and are used to improve the pitch of predetermined tones. The flared bell has a bore attached to the terminal end of the main bore. Braces are attached to the main pipe to maintain structural integrity. The tubular sections, the valved extensions, the mouthpiece, the braces, the pistons and the bell are composed of any rigid material or combination of materials. These materials include, but are not limited to, brass-alloy, monel, aluminum, or steel.

The curved section is constructed as a single composite laminate workpiece independently of the remainder of the instrument. The curved section has a constant radius of curvature as well as a tapered bore diameter. This allows a bore mold to be easily removed from the workpiece after a composite fabrication method has been utilized and the composite laminate has cured. Using a bore mold, the curved section is constructed using the vacuum bag molding, filament winding, or resin transfer molding composite fabrication methods. Braided fiber reinforcement sleeves are used in the vacuum bagging and resin transfer molding methods. The sleeves offer a means to reinforce the curved geometry with consistent laminate thickness. After curing, the workpiece is joined with the remainder of the instrument using a butt joint bonded with adhesive.

DETAILED DESCRIPTION

Figure 3:
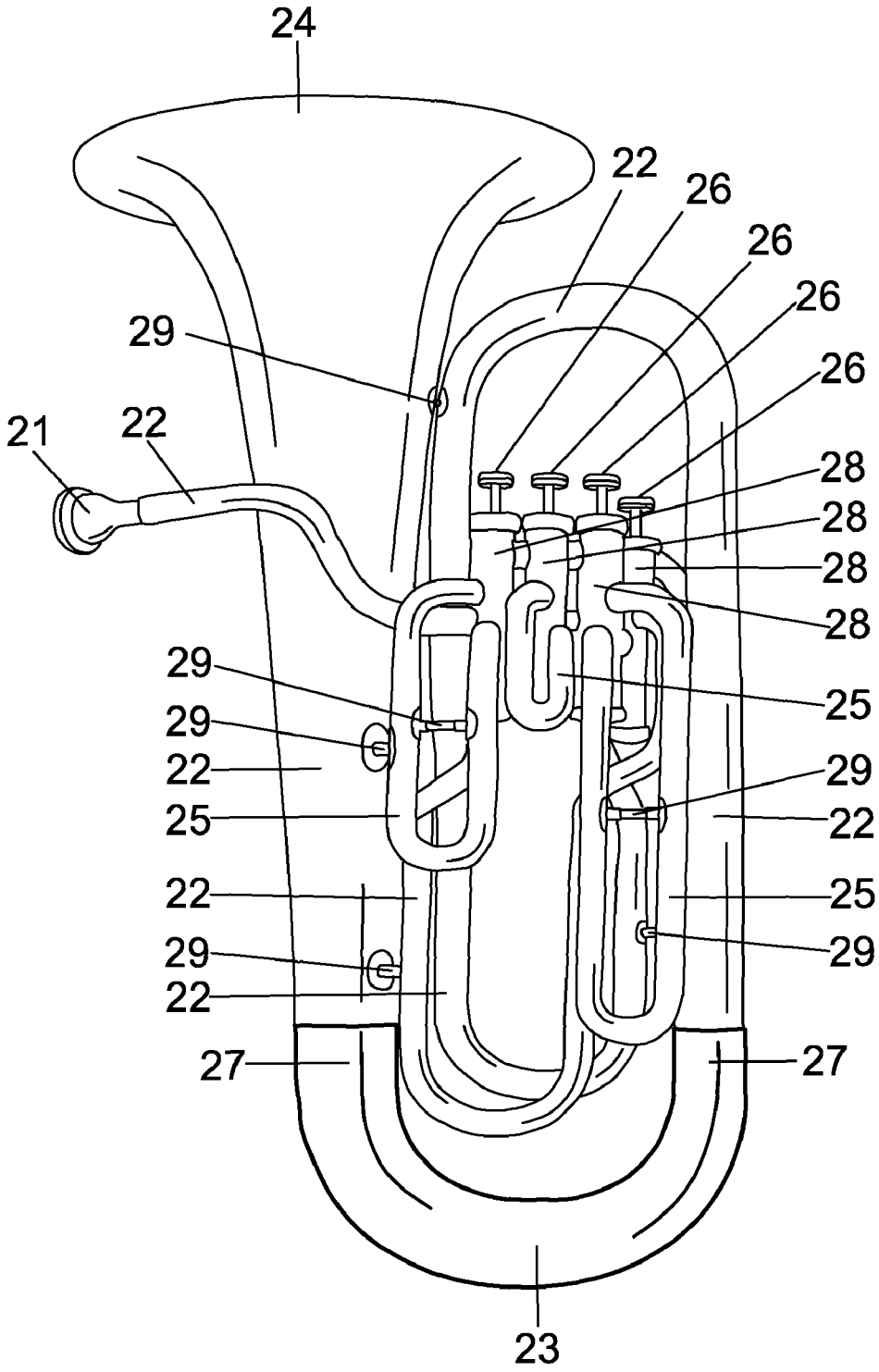
FIG. 3 is a perspective view of the second embodiment of the invention.
Figure 4:
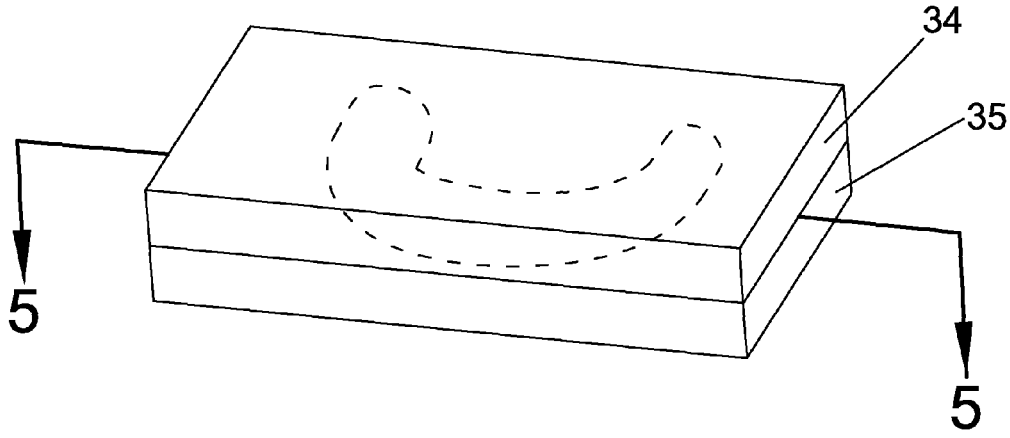
FIG. 4 shows a closed female mold used to fabricate the curved and linear composite laminate sections of the second embodiment.
Figure 5:
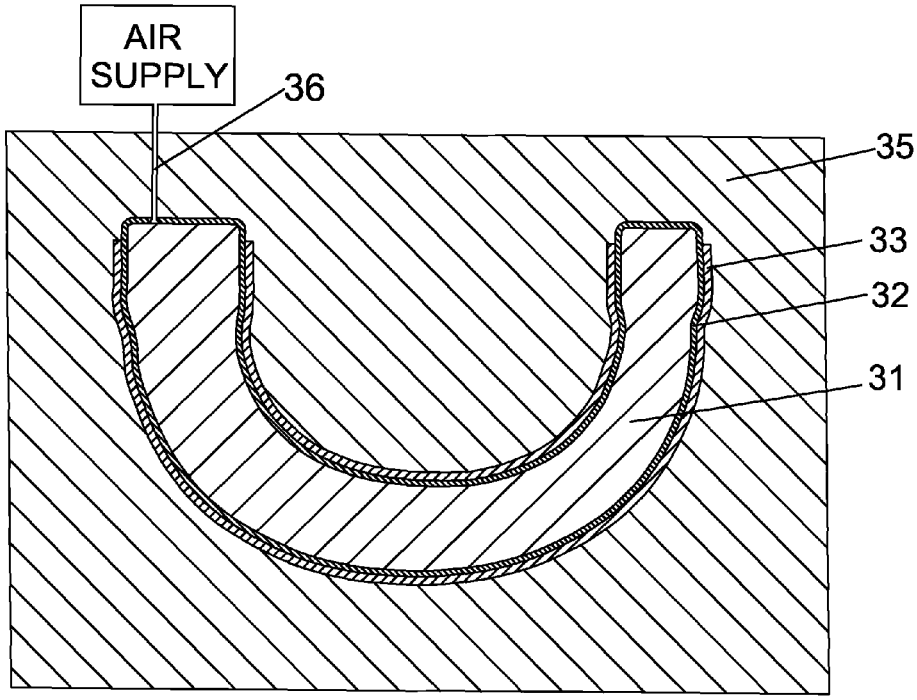
FIG. 5 shows a cross section arrangement to fabricate the composite laminate curved and linear sections of the second embodiment as a single workpiece.

FIGS. 3, 4, and 5—Second Embodiment

FIG. 3 shows a second embodiment of the wind instrument. The instrument has a bored mouthpiece 21, a main pipe, valve casings 28, valved extensions 25, pistons 26, braces 29, and a flared bell 24. The mouthpiece has a mouthpiece bore shaped to propagate acoustic pressure produced by the vibration of a player's lips. The mouthpiece bore is attached to the main bore of the main pipe. The main pipe is composed of a series of interconnected tubular sections 22, a curved section 23 and two linear sections 27. The linear sections are adjacent to the curved section. The curved section and the linear sections are constructed of a composite laminate having at least a layer of carbon fiber reinforcement. The linear sections form an overlapping joint with the adjacent tubular sections of the main pipe and lends for a practical transition between the composite laminate and the remainder of the instrument. The valve casings, pistons and valved extensions are nested within the main pipe and are used to improve the pitch of predetermined tones. The flared bell has a bore attached to the terminal end of the main bore. Braces are attached to the tubular sections and the valved extensions to add structural integrity. The tubular sections, the valved extensions, the mouthpiece, the braces, the pistons and the bell are composed of any rigid material or combination of materials. These materials include, but are not limited to, brass-alloy, monel, aluminum, or steel.

The curved and linear sections of the second embodiment are fabricated as a single workpiece independently from the remainder of the instrument. The single workpiece construction allows for simplified construction with reduced part count. There are two approaches to manufacturing these sections as a single workpiece.

A first approach for constructing the workpiece is according to the vacuum bagging, resin transfer molding or filament winding composite fabrication methods wherein a bore mold is utilized. The bore mold is constructed of a meltable, dissolvable or otherwise disintegrable material. The bore mold must be constructed of disintegrable materials to allow removal from the workpiece. Materials for the mold include but are not limited to a plaster, a wax, or a eutectic salt. The bore mold is removed by disintegration after the workpiece has cured.

A second approach for constructing the workpiece is according to the bladder molding composite fabrication method. The bladder molding method includes:

1) covering a male mandrel with a bladder,
2) covering the bladder with resinous and reinforcement material,
3) inserting the assembly of mandrel, bladder, resinous and reinforcement material into a female mold cavity,
4) applying air pressure to the inside of the bladder causing it to inflate and compact the resinous and reinforcement material against the walls of the female mold cavity, and
5) after sufficient time, removal of the workpiece from the female mold, bladder and mandrel.

FIG. 4 shows the closed female mold used to implement bladder molding of the workpiece. The mold consists of a female mold upper half 34, and a female mold lower half 35. FIG. 4 also defines a cross section that is depicted in FIG. 5.

FIG. 5 shows a cross section of the arrangement to fabricate the workpiece according to the bladder molding fabrication method. The cross section shows a male mandrel 31, a bladder 32, resinous and reinforcement material 33, the female mold lower half 35, and an air supply line 36. The geometry of the workpiece prohibits the use of a rigid male mandrel. For this reason, the male mandrel is composed of compliant or disintegrable material to allow removal after the section is cured. Depending on the desired resin-to-reinforcement ratio, layers of breather cloth and release ply may also be used between the bladder and the resinous and reinforcement material. Braided fiber reinforcement sleeves are used in the resinous and reinforcement layer. The sleeves offer a means to reinforce the curved geometry with consistent laminate thickness. An air supply line is routed to the inside of the bladder to allow for inflation of the bladder and compaction of the resinous and reinforcement material within the female mold. After sufficient time, and perhaps after the application of heat, the cured workpiece is removed from the female mold, the bladder and male mandrel. Release agents are used prior to assembly to facilitate this removal.

DETAILED DESCRIPTION

Figure 6:
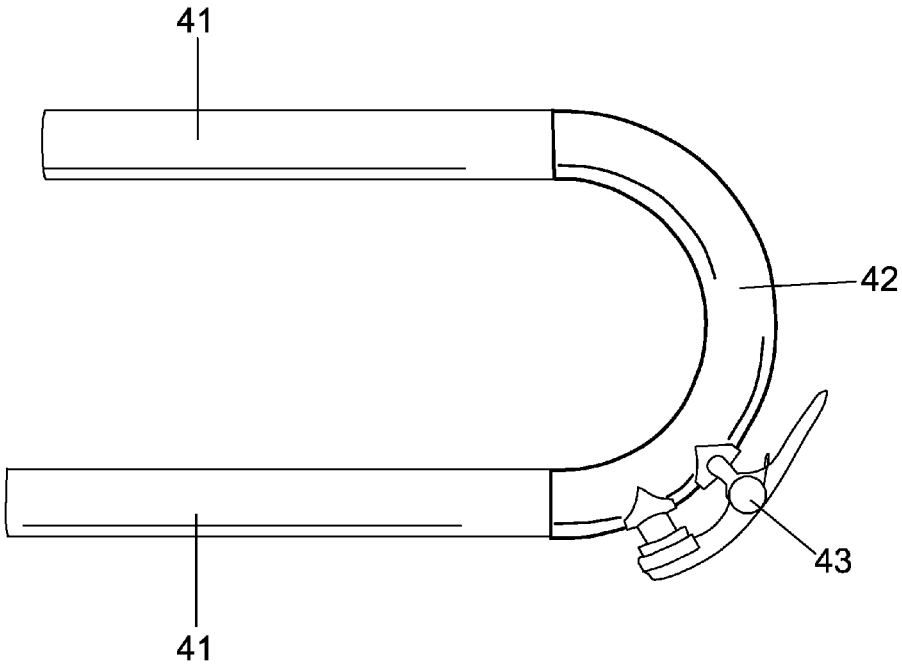
FIG. 6 shows a perspective view of the third embodiment of the invention.

FIG. 6—Third Embodiment

FIG. 6 shows a third embodiment of the invention. The third embodiment is a slide for a wind musical instrument and is composed of two linear tubes 41 and a bight section 42. The two linear tubes are parallel and offset from one another and are sized to telescopically interface with the tubing of a lip-reed instrument. A water key 43 is included in this embodiment and is attached to the bight section. The two linear tubes have linear bores attached to the bore of the bight section. The bight section is constructed of a composite laminate having at least a layer of carbon fiber reinforcement material. The parallel linear tubes can be composed of any rigid material such as, but not limited to, brass alloy, aluminum, steel or carbon fiber reinforced composite laminate.

The bight section of the third embodiment is constructed independently of the remaining components using the approach described for the first embodiment or the two approaches described for the second embodiment. The curved section is joined with the linear tubes using a butt type joint bonded with adhesive. The linear tubes of the third embodiment may be constructed of carbon fiber reinforced composite using available methods to construct linear tubing.

DETAILED DESCRIPTION

Figure 7:
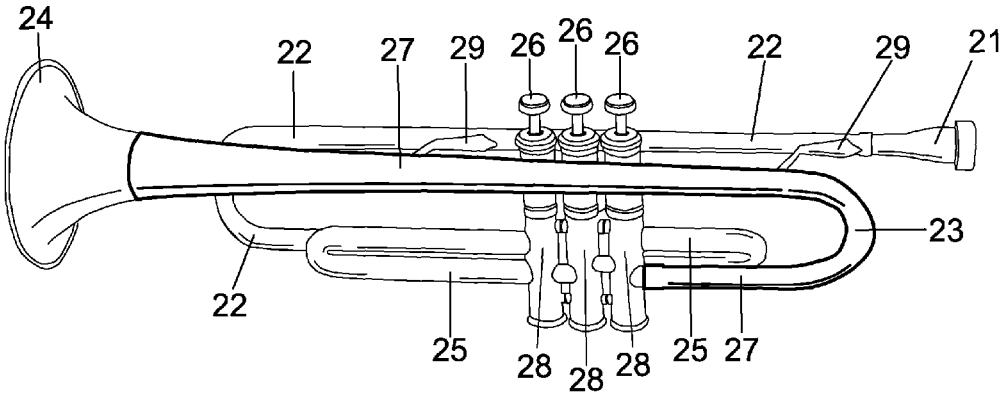
FIG. 7 shows a perspective view of the fourth embodiment of the invention.
Figure 8:
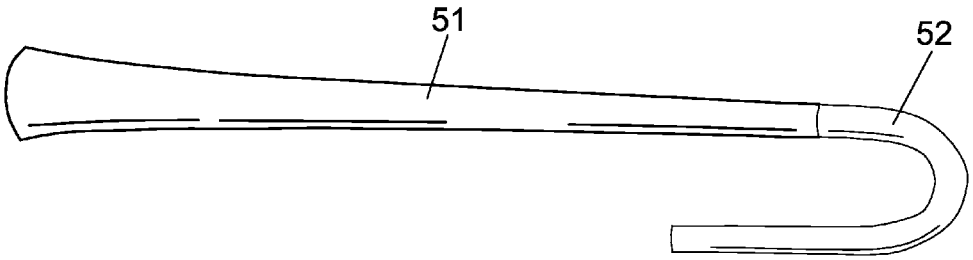
FIG. 8 shows a perspective view of tooling to fabricate the composite laminate curved and linear sections of the forth embodiment as a single workpiece.

FIGS. 7 and 8—Fourth Embodiment

FIG. 7 shows a fourth embodiment of the wind instrument. The instrument has a bored mouthpiece 21, a main pipe, a series of valved extensions 25, valve casings 28, pistons 26, braces 29 and a flared bell 24. The mouthpiece has a mouthpiece bore shaped to propagate acoustic pressure produced by the vibration of a player's lips. The mouthpiece bore is attached to the main bore of the main pipe. The main pipe is composed of a series of interconnected tubular sections 22, a curved section 23, and two linear sections 27. The linear sections are adjacent to the curved section. The curved section and the linear sections are constructed of a composite laminate having at least a layer of carbon fiber reinforcement. The valve casings, pistons and valved extensions are nested within the main pipe and are used to improve the pitch of predetermined tones. The flared bell has a bore attached to the terminal end of the main bore. Braces are attached to the main pipe to add structural integrity. The mouthpiece, the tubular sections, the valved extensions, the braces, the valve casings, the pistons and the bell are composed of any rigid material or combination of materials. These materials include, but are not limited to, brass-alloy, monel, aluminum or steel.

The curved and linear sections of the fourth embodiment are fabricated as a single workpiece independently from the remainder of the instrument. The single workpiece allows for simplified construction with reduced part count. To fabricate the workpiece, the vacuum bagging, resin transfer molding, or filament winding composite fabrication methods are utilized wherein a bore mold is covered with resinous and reinforcement material. FIG. 8 shows a bore mold used to fabricate this workpiece. The bore mold is composed of a rigid section 51, joined with a disintegrable section 52. The rigid section is composed of a rigid material and the disintegrable section is composed of a plaster, eutectic salt, wax or other disintegrable material. After curing, the bore mold is removed from the workpiece. The workpiece is bonded to the remainder of the instrument using an adhesive.

DETAILED DESCRIPTION

Figure 9:
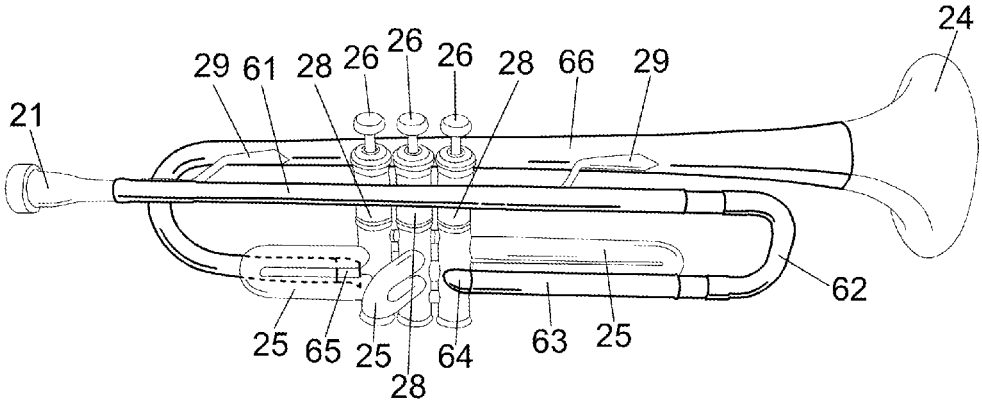
FIG. 9 shows a perspective view of the fifth embodiment of the invention
Figure 10:
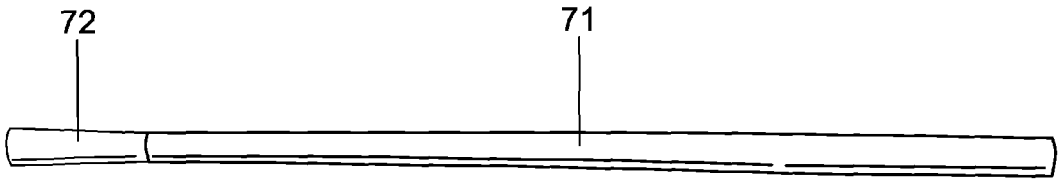
FIG. 10 shows tooling to create the leadpipe of the fifth embodiment as a single workpiece.

FIGS. 9 and 10—Fifth Embodiment

FIG. 9 shows a fifth embodiment of the wind instrument. The wind instrument has a bored mouthpiece 21, a main pipe, valve casings 28, valved extensions 25, pistons 26, braces 29, and a flared bell 24. The mouthpiece has a mouthpiece bore shaped to propagate acoustic pressure produced by the vibration of a player's lips. The mouthpiece bore is attached to the main bore of the main pipe. The main pipe is composed substantially of a composite laminate having at least a layer of carbon fiber reinforcement. The main pipe is composed of the following interconnected subcomponents: a lead pipe 61, a tuning slide 62, a lower tube 63, a first knuckle 64, a second knuckle 65, and a hook pipe 66. The valved extensions, valve casings and pistons are nested within the main pipe and are used to improve the pitch of predetermined pitches. The flared bell has a bore attached to the terminal end of the main pipe. Braces are used to join the hook pipe and the leadpipe. The mouthpiece, pistons, valve casings, valved extensions, braces and the bell are composed of any rigid material or combination of materials. These materials include, but are not limited to, brass-alloy, monel, aluminum or steel.

The subcomponents of the main pipe are each constructed as a single workpiece apart from the remainder of the instrument. The leadpipe is constructed using the vacuum bagging, resin transfer molding or filament winding composite fabrication methods using a bore mold shown in FIG. 10. The bore mold is composed of a long segment 71 and a short segment 72. The short segment is detachable to allow removal of the mold from the workpiece. The tuning slide is constructed according to the fabrication method described for the third embodiment. The lower tube is constructed according to available methods for fashioning linear composite laminate tubing. The first and second knuckles are constructed using the vacuum bagging, resin transfer molding, filament winding or compression molding composite fabrication methods using a bore mold constructed of a disintegrable material. The hook pipe is constructed according to the fabrication method described for the forth embodiment. After curing of the workpieces, the wind instrument is assembled as shown in FIG. 10. An adhesive is used to bond the leadpipe and curved pipe to the braces as well as to bond the first and second knuckle to the lower tube and hook pipe. The knuckles are also bonded to the valve casings with adhesive.

DETAILED DESCRIPTION

Additional Embodiments

Various embodiments of the invention beyond those described herein are contemplated. The carbon fiber reinforced composite laminate can be practically applied to almost any lip-reed instrument commonly used today and further testing is planned to apply these improvements throughout the lip-reed family. A carbon fiber reinforced laminate may be applied to the curved sections and to the main pipe of these instruments to realize improved acoustic qualities. The improvements may also be applied to instruments having no valved extensions or to instruments having a slide mechanism, such as a trombone slide, to tune predetermined pitches.

DETAILED DESCRIPTION

Alternative Embodiments

Various modifications and changes are also contemplated and may be utilized to optimize the vibro-acoustic response of the composite laminate. The stiffness and mass of the composite laminate are important parameters which affect the mode shape natural frequencies. To achieve optimal response, projection and timbre, the laminate thickness and the fiber direction of the laminate will be adjusted. Fiber angles between 0 and 90 degrees away from the bore axis and thicknesses between 0.016 and 0.500 inches will be investigated to achieve optimal vibro-acoustic response. The resins used in composite laminate are also important to the stiffness and damping of the instrument and require optimization. Investigation of several resins is currently planned as well as pre-impregnation of the reinforcement materials with resinous material.

Modifications of the materials used for the mouthpiece, tubular sections, linear tubes, valve casings, pistons, braces, valved extensions and bell are also contemplated. Depending on the outcome of testing these may be composed of a carbon fiber reinforced laminate, brass alloy or other material.

Alternative embodiments of the invention are also contemplated which exploit the benefit of reduced part count offered by the composite laminate construction. The composite laminate construction allows components which were traditionally separate workpieces to be fabricated together as a single workpiece. Of the described embodiments, it is contemplated that the mouthpiece and leadpipe, the bell and hook pipe, the linear tube and bight section, and the lower pipe and knuckle can be made as a single workpiece. Other embodiments will also have a number of components which can be fabricated as a single workpiece.

ADVANTAGES

Embodiments of the present invention utilize a composite laminate having one or more layers of carbon fiber reinforcement as a material to construct the sidewall materials of the wind instrument. Use of carbon fiber reinforced material has several advantages that are explained in the following paragraphs.

Carbon fiber reinforced composite laminate has a high stiffness and a low density compared to the stiffness and mass of brass alloy used in prior art lip-reed instruments. These properties offer an improvement when considering the modal vibration characteristics and the impact on timber and projection qualities. Lip-reed instruments having a main pipe constructed of carbon fiber reinforced composite laminate have higher stiffness and lower mass than prior art brass alloy tubing. Due to this, the mode shapes occur at natural frequencies of higher value compared to a prior art instrument constructed of brass alloy tubing.

Use of carbon fiber reinforced composite laminate is particularly beneficial when applied to curved sections of the instrument's main pipe. The curved sections have inherently lower stiffness than straight sections due to their curved geometry. For this reason the mode shapes have considerable elastic deformation in the curved sections. Lip-reed instruments having curved sections constructed of carbon fiber reinforced composite laminate have significantly higher bending stiffness which results in natural frequencies of higher value compared to brass alloy curved sections. The relatively higher natural frequencies of carbon fiber reinforced instruments improve the instrument's timbre due to better cooperation with acoustic standing waves in the instrument's bore. The mode shape natural frequencies more closely match the natural frequency of the standing waves in the instrument. Due to this, the acoustic radiation coming from the mode shapes cooperates and reinforces the radiation coming from the standing waves. The result is an instrument having better projection and a brilliant timber that is more pleasing to the listener.

The use of carbon fiber reinforced composite laminate for the tubing of lip-reed instruments is superior to brass alloy in terms of corrosion properties. Laminates made of fiber material do not suffer from the galvanic corrosion of brass alloy. Hence the problems of corrosion and scale growth and the associated acoustic and structural degradation are eliminated. This property is also advantageous because it results in an instrument that requires less cleaning and maintenance.

Use of carbon fiber reinforced composite laminate together with the described fabrication methods solves the precision problems that have limited the prior art. Production of composite laminate wind instruments using precision molds achieves smaller geometric tolerances and consistent sidewall stiffness properties. This is particularly beneficial for the curved sections which have precision greatly improved over the prior art. The improvements result in little or no perceptible differences between instruments of common design as well as an enhanced ability to further optimize the instrument design beyond today's designs and standards.

CONCLUSIONS RAMIFICATIONS AND SCOPE

Accordingly, the reader will see that the improvements of the various embodiments offer a superior lip-reed instrument with musical qualities that will be appreciated by players and listeners alike. Furthermore, the invention and associated fabrication method have the additional advantages in that:

- It allows for exacting geometric and stiffness optimization of instrument design and will allow the use of new optimization techniques to be exploited.
- It allows for an instrument that will last for several lifetimes due to elimination of corrosion effects.
- It allows for an instrument of significantly lower weight that will be handled with less effort by players.
- It allows the player a shorter warm up period as the thermal properties of the composite laminate absorb little heat and achieve steady state playing temperatures quickly.
- It allows an instrument design having fewer parts as the fabrication method allows for a continuous laminate to be used in areas that typically required several parts to be fabricated.
- It allows production of the instrument while requiring less time and fewer operations.

Although certain embodiments of the present invention have been shown and described in detail, it should be understood that various changes and modifications may be made therein without departing from the scope of the appended claims. Thus the scope of the embodiments should be determined by the appended claims and their legal equivalents, rather than by the examples given.

What is claimed is:

1. A wind instrument comprising:

a. a mouthpiece having a mouthpiece bore suited to propagate the vibrations produced by human lips, b. a main pipe having a main bore first end of first section connected with the terminal end of said mouthpiece bore, and said main pipe composed of multiple sections having at least one curved section having tubular walls composed substantially of a composite laminate, said composite laminate having at least a layer of carbon fiber reinforcement and having single-workpiece construction in said tubular walls, c. a flared bell having a bore connected to the other terminal end of said main bore at the last main pipe section.

2. The wind instrument according to claim 1, wherein said main pipe has at least one valved extension to improve predetermined pitches.

3. The wind instrument according to claim 1, wherein said main pipe has at least one extendable slide to improve predetermined pitches.

4. The wind instrument according to claim 1, wherein said composite laminate has a thickness between 1/64 (0.016) and 1/2 (0.500) inches and has a plurality of fibers oriented from 0 degrees to plus or minus 90 degrees from the bore axis so as to provide optimal response, projection and timbre qualities.

5. The wind instrument according to claim 1, wherein said main pipe has one or more other sections having tubular walls composed substantially of at least one composite laminate having at least a layer of carbon fiber reinforcement.

6. The wind instrument according to claim 1, wherein said composite laminate has at least a layer of braided fiber sleeve reinforcement.

7. The wind instrument according to claim 1, wherein said main pipe has at least one attached brace composed of a composite laminate having at least a layer of carbon fiber reinforcement.

8. The wind instrument according to claim 1, wherein said main pipe has two linear sections adjacent to said curved section, said linear sections having tubular walls composed of said composite laminate.

9. The wind instrument according to claim 2, wherein said main pipe has a nested valve casing composed of a composite laminate having at least a layer of carbon fiber reinforcement.

10. The wind instrument according to claim 2, wherein said main pipe has a curved knuckle adjacent to said valved extension, said knuckle having tubular walls composed of a composite laminate having at least a layer of carbon fiber reinforcement.

11. A slide for a wind instrument comprising:

a. two linear tubes positioned offset and parallel to each other, having linear bores and being suited to telescopically interface tubing of an instrument body, b. a bight section having an internal bore connected to said linear bores, and said bight section having tubular walls composed substantially of a composite laminate having at least a layer of carbon fiber reinforcement, said composite laminate having single-workpiece construction.

12. The slide according to claim 11, wherein said linear tubes are composed of a composite laminate having at least a layer of carbon fiber reinforcement.

13. The slide according to claim 11, wherein said linear tubes have tubular walls composed of said composite laminate.

14. The slide according to claim 11, wherein said composite laminate has at least a layer of braided fiber sleeve reinforcement.

15. A method of making tubular walls of a wind musical instrument of a section that has a linear portion and a curved portion according to the resin transfer molding process, steps including:

a. providing a multi-piece bore mold, said multi-piece bore mold having shape and size related to the bore of a wind musical instrument and having at least one rigid section and at least one disintegrable section, said disintegrable section having curved geometry;

b. covering said multi-piece bore mold with fiber reinforcement material;

c. inserting said multi-piece bore mold and said fiber reinforcement material into a female mold;

d. transferring a resin into or onto the said multi-piece bore mold and said female mold and curing the said resin, thereby forming a laminate material tubular wall section of a wind musical instrument;

e. removing said female mold from the said laminate material tubular wall section;

f. removing the said rigid section(s) of the said multi-piece bore mold intact from the said laminate material tubular wall section;

g. removing the said disintegrable section(s) from said laminate material tubular wall section by disintegration.

16. The method according to claim 15, wherein said disintegrable section is composed of a material selected from the group consisting of plaster, wax, and eutectic salt.

17. The method according to claim 15, wherein said fiber reinforcement material is a braided fiber sleeve reinforcement material.

18. A method of making curved tubular walls of a wind musical instrument comprising:

a. providing a male mandrel having curved geometry of related shape and size of the bore of a curved tubular wall section of a wind musical instrument, b. covering said male mandrel with a bladder, c. covering said bladder with resin and fiber reinforcement material, d. inserting said male mandrel, said bladder, said resin and said fiber reinforcement material into a female mold having the shape of the exterior of a curved tubular wall section of a wind musical instrument, e. applying air pressure to said bladder, thereby compacting said resin and said fiber reinforcement material against said female mold, f. curing said resin material, thereby forming a laminate material curved, tubular wall section of a wind musical instrument, g. removing said laminate from said female mold, said bladder and said male mandrel.

19. The method according to claim 18, wherein said male mandrel is composed at least in part of a disintegrable material.

20. The method according to claim 18, wherein said fiber reinforcement material is a braided fiber sleeve reinforcement material.

* * * * *

US008324491C1

(12) EX PARTE REEXAMINATION CERTIFICATE (13th)

Ex Parte Reexamination Ordered under 35 U.S.C. 257

United States Patent
Malluck

(10) Number: US 8,324,491 C1
(45) Certificate Issued: Aug. 27, 2014

(54) WIND INSTRUMENT UTILIZING CARBON FIBER REINFORCED COMPOSITE LAMINATE AND ASSOCIATED FABRICATION METHOD

(76) Inventor: John Andrew Malluck, Richmond Hill, GA (US)

Supplemental Examination Request:
No. 96/000,024, Jun. 8, 2013

Reexamination Certificate for:

| | |
|---|---|
| Patent No.: | **8,324,491** |
| Issued: | **Dec. 4, 2012** |
| Appl. No.: | **13/035,957** |
| Filed: | **Feb. 26, 2011** |

(51) Int. Cl.
*G10D 9/00* (2006.01)

(52) U.S. Cl.
USPC ..... 84/387 R; 84/380 R

(58) Field of Classification Search
None
See application file for complete search history.

(56) References Cited

To view the complete listing of prior art documents cited during the supplemental examination proceeding and the resulting reexamination proceeding for Control Number 96/000,024, please refer to the USPTO's public Patent Application Information Retrieval (PAIR) system under the Display References tab.

*Primary Examiner* — Peter C. English

(57) ABSTRACT

A lip-reed wind instrument composed substantially, or in part, of carbon fiber reinforced composite laminate and an associated method to fabricate the instrument. Carbon fiber reinforced composite laminate is used to construct the tubular sidewalls of the instrument and is beneficial to the musical character. The high stiffness and low density of carbon fiber reinforced composite laminate increases the frequency of the instrument's vibration mode shapes allowing a favorable cooperation with musical pitch. The result is an instrument having improved projection as well as a brilliant timbre. The associated fabrication method describes the specialized tooling and the techniques to construct the laminate features of the instrument. The construction methods together with the improvements result in an instrument of higher precision allowing consistent play qualities for instruments of like design.

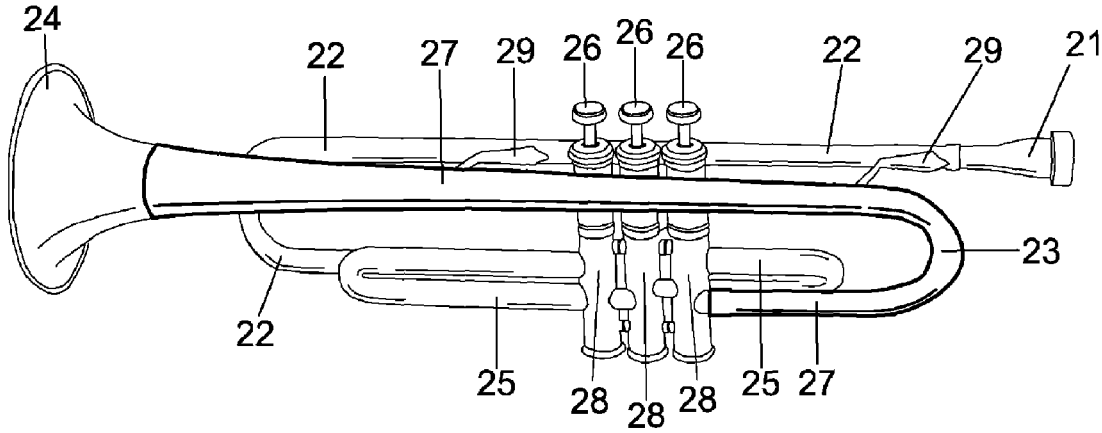

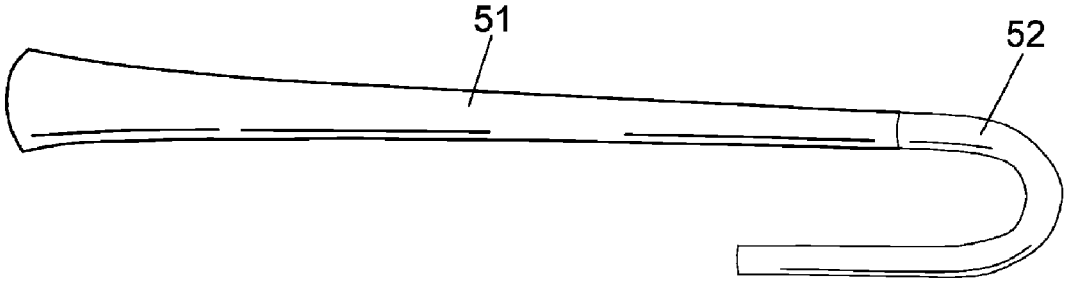

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 15-17 is confirmed.

Claims 1-10 and 18-20 are cancelled.

Claims 11-14 were not reexamined.

* * * * *